US008186132B2

(12) United States Patent
Howery, Jr. et al.

(10) Patent No.: US 8,186,132 B2
(45) Date of Patent: May 29, 2012

(54) NO-THROUGH-METAL STRUCTURAL PANELIZED HOUSING SYSTEM FOR BUILDINGS AND ENCLOSURES AND ECONOMICAL PROCESS FOR MANUFACTURE OF SAME

(75) Inventors: Douglas J. Howery, Jr., O'Fallon, MO (US); Charles E. Christiansen, Nixa, MO (US)

(73) Assignee: Johnson Heater Corp., St. Louis, MO (US)

( * ) Notice: Subject to any disclaimer, the term of this patent is extended or adjusted under 35 U.S.C. 154(b) by 183 days.

(21) Appl. No.: 12/437,756

(22) Filed: May 8, 2009

(65) Prior Publication Data

US 2009/0277122 A1 Nov. 12, 2009

Related U.S. Application Data

(60) Provisional application No. 61/051,521, filed on May 8, 2008.

(51) Int. Cl.
*E04C 2/40* (2006.01)

(52) U.S. Cl. ..... 52/792.1; 52/783.1; 52/262

(58) Field of Classification Search ..... 52/792.1, 52/783.1, 262, 264, 266–268, 270, 272
See application file for complete search history.

(56) References Cited

U.S. PATENT DOCUMENTS 3,110,370 A * 11/1963 Wulf, Jr. et al. ..... 52/792.1
3,336,713 A * 8/1967 Privas ..... 52/573.1
3,512,305 A * 5/1970 Multer ..... 49/503
3,599,703 A * 8/1971 Mennuto et al. ..... 160/90
3,750,333 A * 8/1973 Vance ..... 49/501
3,837,134 A * 9/1974 DiFazio ..... 52/784.13
4,157,641 A * 6/1979 Hasselbacher ..... 52/656.9
4,183,393 A * 1/1980 Bailey ..... 160/232
4,589,240 A * 5/1986 Kendall et al. ..... 52/309.11
4,897,971 A * 2/1990 Durston ..... 52/238.1
5,860,265 A * 1/1999 Knudson et al. ..... 52/846
6,321,504 B1 * 11/2001 Svensson ..... 52/650.1
6,374,571 B1 * 4/2002 Mann ..... 52/783.1
6,415,557 B1 * 7/2002 McCalley ..... 52/79.1
6,974,383 B2 * 12/2005 Lewis et al. ..... 454/338
7,493,729 B1 * 2/2009 Semmes ..... 52/79.1
7,526,903 B2 * 5/2009 Kandasamy ..... 52/782.1
7,540,123 B1 * 6/2009 Semmes ..... 52/783.19
7,937,895 B2 * 5/2011 Janka et al. ..... 52/79.1
2005/0066609 A1 * 3/2005 Olah ..... 52/633

OTHER PUBLICATIONS

Air Enterprise, "AE Product Basics, Construction Review", http://www.airenterprises.com/docs/UnitConstructionBasics.pdf, 16 pages (available at least as early as Aug. 17, 2009).*

(Continued)

*Primary Examiner* — William Gilbert
*Assistant Examiner* — Beth Stephan
(74) *Attorney, Agent, or Firm* — Lewis, Rice & Fingersh, L.C.

(57) ABSTRACT

A metal panel generally constructed from sheet material, such as sheet metal, and assemblies thereof which can be used to construct an enclosure, and specifically a no-through-metal enclosure. There is also provided methods for constructing a floor, walls, and roof of a no-through-metal enclosure utilizing such panels or construction techniques. The construction can still utilize metal fasteners such as rivets, bolts, or screws for maintaining strength which still maintaining the no-through-metal construction.

17 Claims, 7 Drawing Sheets

OTHER PUBLICATIONS

Air Enterprise, "AE Product Basics, AE Features and Benefits Discussion", http://www.airenterprises.com/docs/AE_Features_Benefits.pdf, 17 pages (available at least as early as Aug. 17, 2009).*

Modular Framing Systems, Inc., "General Catalog," Jan. 2001, 20 pages.

* cited by examiner

NO-THROUGH-METAL STRUCTURAL PANELIZED HOUSING SYSTEM FOR BUILDINGS AND ENCLOSURES AND ECONOMICAL PROCESS FOR MANUFACTURE OF SAME

CROSS REFERENCE TO RELATED APPLICATION(S)

This application claims benefit of U.S. Provisional Patent Application Ser. No. 61/051,521 filed May 8, 2008 the entire disclosure of which is herein incorporated by reference.

BACKGROUND

1. Field of the Invention

This invention relates to panels for constructing enclosures, specifically thermal isolation enclosures and methods and systems for construction of thermally isolated enclosures, such as built-in refrigeration units, air-handling units, mechanical rooms, and HVAC enclosures.

2. Description of the Related Art

There is a general desire in industry to provide for thermal isolation of a variety of systems. Thermal isolation allows for temperature inside a housing to be manipulated independent of the temperature outside the housing. This can be valuable in places such as Heating, Ventilation, and Cooling (HVAC) systems which are intended to modify air temperature and then provide the altered air temperature to a building or other structure to regulate its internal temperature. Similarly, certain areas of a structure may comprise temperature controlled rooms. Enclosures such as walk-in refrigerators or freezers can require thermally isolated enclosures to operate efficiently and effectively, While systems of these types seek thermal isolation because of alteration of the temperature of the air internal to the enclosure and efficiency in maintaining the air temperature, other systems seek thermal isolation for purposes beyond efficiency.

In "clean room" applications or in facilities that process food, pharmaceuticals, or other products intended for human consumption there can be concerns if temperature differentials become apparent. The internal air of these facilities often needs to be climate controlled to provide for a safe and comfortable working and processing environment. However, when there are temperature differentials at walls or other surfaces, there can be condensation from natural environmental air which can result in the introduction of chemicals to manufactured products which can be harmful to the end users.

The enclosures for HVAC, air handling, and similar system components generally share a few common features to provide for improved thermal and other factor insulation. Firstly, the enclosures are generally designed to be sealed and relatively airtight. This allows the system to prevent external air, which is not filtered and may contain contaminants and will also generally be at a different temperature, from entering the system and being used as make up air for the facility. This allows dust, pollutants, and allergens to be filtered out of the air before it is supplied to the generally enclosed environment. Further, it keeps efficiency of the system up by inhibiting temperature controlled air from not being kept segregated.

Conductive insulation and segregation has traditionally been supplied by the inclusion of insulation in the walls of the enclosure. The enclosure will generally have insulation, such as foams, spun fibers, or even air, in wall panels. The wall panels themselves are generally constructed of aluminum or a similar metal to provide for a solid, generally non-permeable, surface, Further, as many of this enclosures are located outside of the principle structure (such as on a roof) metal can provide for strong, resistant, generally weatherproof outer and inner surface to prevent damage to the insulation from exposure to the elements. Further, even on interior or partially interior installations, metal surfaces, such as aluminum or stainless steel can provide for surfaces which are readily cleaned and disinfected to provide for necessary sanitation.

In particularly demanding applications, the use of aluminum or other metal as the interior and exterior surfaces of the enclosure can result in very small "breaks" in the thermal isolation properties of the housing. In particular, the use of metal surfaces, along with the requirement to solidly connect components together such as with rivets, screws, and the like can result in their being a traceable "path" of metal through the insulation in the walls which can provide for a thermal passageway. This can result in possible condensation where metal joins the exterior and the interior of the enclosure due to a temperature differential, and can also cause decreases in efficiency.

In applications such as clean rooms, pharmaceutical, food, or microelectronic manufacturing, even a very small amount of condensation entering the environment can result in potentially catastrophic consequences due to the need to precisely control the chemical makeup of the air in these facilities, and to provide that contaminants are not introduced to the manufactured goods. These types of applications therefore focus on complete thermal isolation where there are no metal paths which can result in local temperature variations on the internal, or external, walls.

To provide for this demanding type of application, the construction of such enclosures attempts to provide a structure which is referred to as "no-through-metal" construction. A no-through-metal enclosure is constructed in such a way that there is no metal to metal connections which can be traced from metal in contact with air outside the outer surface of the enclosure to a piece of metal on the interior of the enclosure. Effectively, every path, no matter how small, needs to pass through a thermal break, or a layer of thermal insulation designed to inhibit a temperature differential from passing between the two outer walls.

The requirements of no-through-metal construction are very demanding as even standard connection components such as rivets, screws, or welds can provide the metal pathway. Further, corners, where construction techniques can require certain types of connections, can be problematic in building no-through-metal enclosures. The problem is further compounded by a desire to make construction of such enclosures modular. While modular components can provide for easier and less expensive construction, they also often require the use of more connectors and different structures which often make it hard to keep metal from providing a through path since the modular construction often provides for insulation encased in metal panels and the need to interconnect metal pieces to other metal pieces using metal connectors which can penetrate thermally insulative layers placed between them.

In order to construct no-through-metal enclosures a number of expensive and manufacturing intensive schemes have previously been used. In particular, in many such constructions connectors are entirely non metal and utilize plastic, resin, or fiber material based rivets and screws. This can be effective to create a no-through-metal structure as one of the most common sources of a metal pathway is a connector, such as a rivet, passing between two metal sheets which are otherwise separated by an insulative sheet. While effective, however, this process is often prohibitively expensive and can result in structures that are not as secure as the alternative material fasteners lack the strength of traditional metal fasteners.

Alternatively, some manufacturers use extruded components of aluminum which can then have injected therein insulative foams, resins, or other structures which serve to provide structural support and act as support beams. A portion of the aluminum can then be milled away around the hardened resin or foam to eliminate a metal path and isolate the metal components. From this type of construction, metal plates can be added either external or internal on the beams, utilizing the small resin component as a thermal break.

These devices traditionally are in the form of "I" beams or similar shapes with a specially designed void for the resin in the center of the "I". Once the beam is formed, the center is filled with a thermal break material, such as insulating foam or resin which has sufficient structural integrity to support the remaining metal once it has hardened or cured. Once the resin is cured, strips of aluminum can be removed by processes such as milling which breaks the metal construction effectively breaking the "I" in the center providing that no metal extends across the line. The beams then are positioned to provide for the support structures for external and internal sheet metal which are attached at the top and bottom of the "I" using metal connectors but maintaining the thermal break from the resin block in the center. The resulting empty space is then filled with additional insulation.

While these structures are effective at forming no-through-metal buildings, they can very expensive to construct. In the first instance, due to their unique shape the "I" beams require the use of extruded metals, which require expensive molds and processes to form. Further, the curing and milling process is also expensive and requires additional steps in construction For this reason, the resulting enclosures constructed using these materials are often significantly more expensive than structures which have only a very limited amount of through metal limiting their use to where such construction is absolutely necessary, and cost is effectively not a factor in determining the nature of the construction. At the same time, construction of less efficient enclosures, while often less expensive in the actual enclosure construction, results in increases in cost due to the need for the enclosure to include a safety factor which requires larger enclosures or more powerful components to compensate for leakage and poor enclosure quality without compromising the resultant air quality.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein are, among other things, a modular construction component designed for the construction of buildings. In an embodiment, the component utilizes sheet metal in its construction but which provides for a no-through-metal formation, while still providing for a basic building block from which metal structures can be formed. There is also described an enclosure constructed utilizing these concepts as well as such components.

There is described herein, among other things, a no-through-metal enclosure, the enclosure comprising; a plurality of generally C-shaped panels, each of the panels being formed from a sheet of bent metal, the panels comprising: an outer wall; two legs attached to the outer wall; and two connecting surfaces, each of which is attached to one of the legs; metal fasteners connecting at least a portion of the panels to each other; wherein a panel whose outer surface forms a portion of an outer metal surface of the enclosure is connected to an interior metal surface of the enclosure only via an insulative strip which is placed on the connecting surface; and wherein the enclosure has no-through-metal from the outer metal surface to the interior metal surface.

In an embodiment of the enclosure, the interior metal surface is at least partially formed from a second plurality of panels which are connected via the connecting surfaces to the insulative strip. The second plurality of panels may form an interior wall.

In another embodiment of the enclosure the interior metal surface is at least partially formed from a flat sheet of metal which is connected to the insulative strip. The flat sheet of metal may form a floor.

In an embodiment of the enclosure the legs of adjacent panels are connected by the metal fasteners.

There is also described herein, a no-through-metal enclosure, the enclosure comprising; at least one generally C-shaped panel formed from a sheet of bent metal, the panels comprising: an outer wall; two legs attached to the outer wall; and two connecting surfaces, each of which is attached to one of the legs; wherein a panel whose outer surface forms a portion of an outer metal surface of the enclosure is connected to an interior metal surface of the enclosure only via an insulative strip which is placed on the connecting surface; and wherein the enclosure has no-through-metal from the outer metal surface to the interior metal surface.

In an embodiment of the enclosure the interior metal surface is at least partially formed from a second panel which is connected via the connecting surfaces to the insulative strip.

In another embodiment of the enclosure the interior metal surface is at least partially formed from a flat sheet of metal which is connected to the insulative strip.

There is also described herein, a method of constructing an enclosure comprising: providing at least one generally C-shaped panel formed from a sheet of bent metal, the panel comprising: an outer wall; two legs attached to the wall; and two connecting surfaces, each of which is attached to one of the legs; using the panel outer wall to form at least a portion of an exterior surface of the enclosure; placing on each of the connecting surfaces an insulative strip; attaching to the insulative strips a metal construct which will form an interior surface of the enclosure; and filing the space between the exterior surface and the interior surface with an insulative material.

In an embodiment of the method, the metal construct comprises a second C-shaped panel formed from a sheet of bent metal which is connected via the connecting surfaces to the insulative strip.

In another embodiment of the method, the metal construct comprises a flat sheet of metal There is also described herein, an enclosure comprising: at least one generally C-shaped panel formed from a sheet of bent metal, the panel comprising: an outer wall; two legs attached to the wall; and two connecting surfaces, each of which is attached to one of the legs; insulating means for connecting the connecting surfaces to a metal construct which will form an interior surface of the enclosure; and insulating means for filing the space between the exterior surface and the interior surface.

DESCRIPTION OF THE PREFERRED EMBODIMENT(S)

Figure 2A:
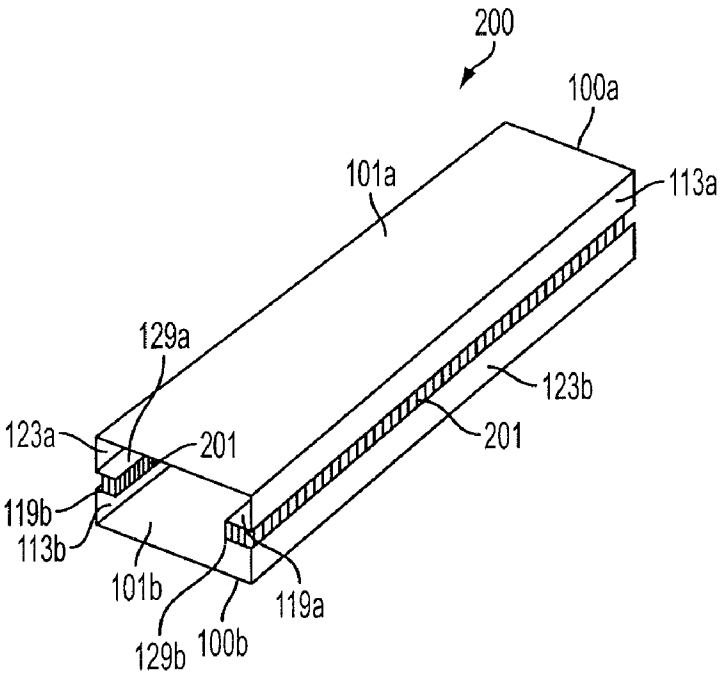
FIG. 2A shows a perspective view of a construct formed from two half panels.

The following detailed description illustrates by way of example and not by way of limitation. Described herein, among other things, is a modular construction technique and modular panels which can be used to form a no-through-metal enclosure without the need to construct extruded metal structures such as "I" beams. There is also provided a no-through-metal enclosure which can be manufactured of such panels and methods for forming a no-through-metal enclosure using such panels.

Throughout this disclosure, there will be discussed a no-through-metal enclosure. Such an enclosure is defined as an enclosure where no path can be traced from a metal exterior surface to a metal interior surface which comprises only metal to metal connections without break. A metal to metal connection exists in any place where there is either: a continuous piece of metal or that there is a metal to metal connection such as when a metal connector, such as a rivet, passes through another piece of metal, such as a metal sheet. Such a no-through-metal enclosure can be considered thermally isolated from interior to exterior.

Generally, the enclosure herein will be constructed of modular components so as to make for easy construction. These modular components are referred to as "panels" and are designed to provide for the interior and exterior surfaces of the enclosure in a fashion where the panels can be connected together. However, one of ordinary skill would recognize that the design and methods discussed in conjunction with panels would allow the enclosure to also be constructed of a singular panel per major surface. Further, the panels as discussed herein may also be used in conjunction with other techniques and components to provide for the enclosure. It should be recognized that panels can be pre-constructed and then later assembled to form the structure, or may be constructed on site to meet particular needs.

The panels may be of a variety of different sizes depending on their use, but will generally share a shape. Full panels are those which are designed to form the thickness of the wall and be used singly, with a flat aluminum sheet being attached to at least one side thereof when the enclosure is constructed. Half panels utilize a mirrored construction whereby two half panels together form the thickness of the walls and there is no need to utilize additional aluminum sheets unless that is otherwise desired.

The enclosure may be constructed from panels with a variety of techniques and the panels may be used in enclosures which are manufactured for insulation in a modular, sectionalized, tilt-up, prefabricated, field built, or other design. The panels may also be used in enclosures which do not meet the no-through-metal requirements as simply modular construction pieces.

The enclosure will generally share a number of common features. In particular, the structure is designed to have both exterior and interior surfaces which are substantially made of a sheet material and may include metal or be entirely metallic such as by being a sheet of metal. The metal may be of any type but will generally comprise aluminum, steel, stainless steel, galvanized steel or other metal or metal alloy which exhibits good resistance to corrosion. The metal will often be the flat portion of the metal panels and form the interior and exterior walls of the enclosure, but alternatively the walls of the enclosure may be formed from a metal, or other material, sheet which is overlaid on the panels forming any particular surface or surfaces.

In alternative embodiments sheet materials which are not made of metal may be used, in such embodiments, the sheet material may comprise plastic, paper, or other materials which are not metal but which can be provided in sheets and folded into the requisite shapes discussed herein. In this embodiment, construction of anon-through-metal enclosure is substantially easier as there is less metal which must be dealt with. Thus, for purposes of this disclosure, the panel will generally be assumed to be constructed of sheets of metal as that construction best illustrates how the no-through-metal arrangement may be obtained even using metal as a principle construction material. If metal is not used, the structure may be able to provide improved thermal isolation due to the construction and assembly methods and systems described herein being used over structures of similar materials utilizing different construction.

The structure of the enclosure comprising multiple panels may also be held together with connectors. These will be connectors designed to hold together various metal panels as well as constructs of the metal panels and will generally be themselves constructed of metal. It is recognized that the particular material used in the connectors may be anything and non-metal connectors may be used in an embodiment, however, one concern with use of non-metallic connectors is their dramatically increased price and the use of metallic connectors has previously often created the problem of the metal pathway keeping the enclosure from having a no-through-metal design. Therefore, to illustrate that the use of metal connectors in conjunction with the panels, construction, and enclosures of the present disclosure still does not create a metal path, this disclosure will generally presume that metal connectors, such as, but not limited to, welding, rivets, screws or bolts are used. However, non-metal connectors can be used in alternative embodiments in construction of the enclosure.

The structure also uses insulative or thermal break materials. These materials may comprise a number of different materials and herein will generally comprise two types. The first type is sheet or tape material. This type of material will generally provide for two metal components to be attached together with a generally continuous or discontinuous seal. However, they will be generally adhesive to maintain the relative locations of components when attached via the sheet or tape. For example, a filler tape which allows for two metal surfaces to be stuck together can be used in an embodiment. It is generally preferred that such strip material have a high resistance to damage, and a good maintenance of adhesive retention, when in contact with common environmental solvents such as water or salt. It is also generally preferred that such materials also have good resistance to common motor chemicals such as oils. These tapes are designed to provide for a generally permanent connection equivalent to welding or rivets but are insulating and can act as a thermal break.

In effect, where sheet insulation is used, it is designed that the sheet serve to maintain a distance between pieces in contact with the opposing sides of the sheet. Further, sheet insulation may be able to be adhesive or otherwise attached to the structures directly, or may be glued or otherwise attached. Alternatively other non-metal connectors may be used in conjunction with the sheet materials to provide further structure. In particular, sheet insulation is designed to form a thermal barrier without through-metal. In an embodiment, insulative means such as filler tapes or other adhesive insulations, sheet insulations, such as but not limited to, foam or resin sheets, and other insulative materials which can be formed into sheets can be used, either alone or in combination, to provide for such a thermal barrier.

Further, it should be recognized that the resultant walls of the enclosure will include filler insulation which is insulation principally designed to fill open voids. The insulation or insulation means will often be supplied as a foam or resin, but may be more traditional insulation such as spun fiberglass or related materials, or even air or vacuum can be used in particular embodiments. Thus, while filler insulation may provide structural properties to the walls of the enclosure, it will generally not be required to provide structural support in order for the structure to remain freestanding. The only requirement of filler insulation is that it provide for filler within the specified locations.

One of ordinary skill would recognize that the same type of insulation may act as both filler and sheet insulation. In particular, the location of sheet insulation may be positioned with simply a gap where the sheet would be, the gap then being filled by filler which cures and forms a layer of sufficient strength to act as a sheet. Further, the same material may be used as a filler. Further, one of ordinary skill would recognize that it is possible to provide for filler insulation which has sufficient structural strength to maintain discussed components in their relative position such that the locations of sheet insulation herein need not provide any structural support. However, these alternatives are generally less preferred as they are more complicated to construct and take more effort to make function in the same way as the embodiments described herein. Therefore, while such constructions are contemplated by this disclosure, they are discussed in less detail since they are generally not preferred.

Figure 1:
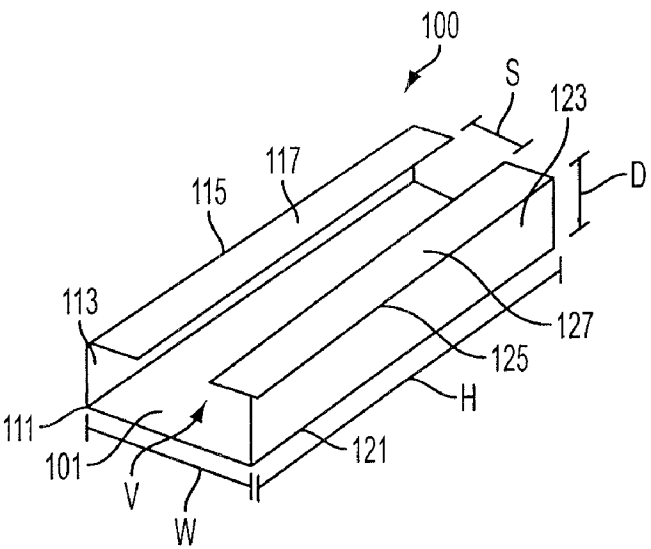
FIG. 1 provides for a perspective view of a panel which can be used to form a no-through-metal enclosure.

FIG. 1 provides for a perspective view of a panel (100) which may be used to construct a no-through-metal enclosure as described herein. As can be seen from FIG. 1, the panel (100) comprises a generally elongated structure having a longitudinal dimension (H), a latitudinal dimension (W), and a depth dimension (D). The panel (100) is generally formed from a single, relatively thin sheet of metal which is bent into the shape shown by providing for four folds in the sheet. In this way, sheet metal may be used in construction of the panel (100) as opposed to having to utilize extruded metal making the panel (100) much easier and less expensive to form then extruded constructions. At the same time, in alternative embodiments, the panel (100) may be constructed by alternative construction methods such as extrusion, if desired.

The panel (100) comprises a generally blocky or angular "C" shape having an outer wall (101) which is the back of the "C" and which is generally planar in the plane of the longitudinal (H) and latitudinal (W) dimensions which will be referred to herein as being generally "C-shaped." There are first and second bend lines (111) and (121) which run the longitudinal (H) direction and cause the panel to form legs (113) and (123) of the "C" which extend the depth (D) from the plane of the outer wall (101). Each of the legs (113) and (123) then terminates in a connecting surface (117) and (127) which is also connected to the legs (113) and (123) by a fold (115) and (125). The connecting surface (117) or (127) generally extends back inward from the legs (113) and (123) in the latitudinal dimension (W) and will generally be arranged so as to be generally in a plane parallel with the outer wall (101). The two connecting surfaces (117) and (127) are arranged so as to be spaced from each other by a distance (S). The panel (100) will generally be constructed so that the folds (111), (115), (121) and (125) are as square as possible providing for sharp turns, however, it is recognized that the folds (111), (115), (121) and (125) will likely include a small curve simply due to limitations of known manufacturing techniques.

Figure 3:
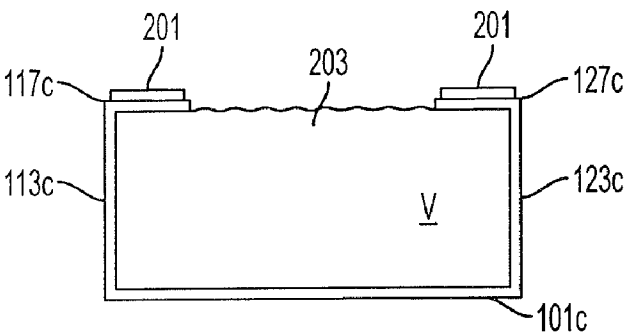
FIG. 3 shows a cut through view of a construct formed from a single full panel.

When viewed down the longitudinal dimension (H) as shown in FIG. 3 the panel (100), in this embodiment, will provide for a generally rectangular cross section which is incomplete on one of the long sides. The panel (100) also generally encloses a volume (V) which is roughly defined as the space internal the outer wall (101), legs (113) and (123), and support surfaces (117) and (127).

Figure 6:
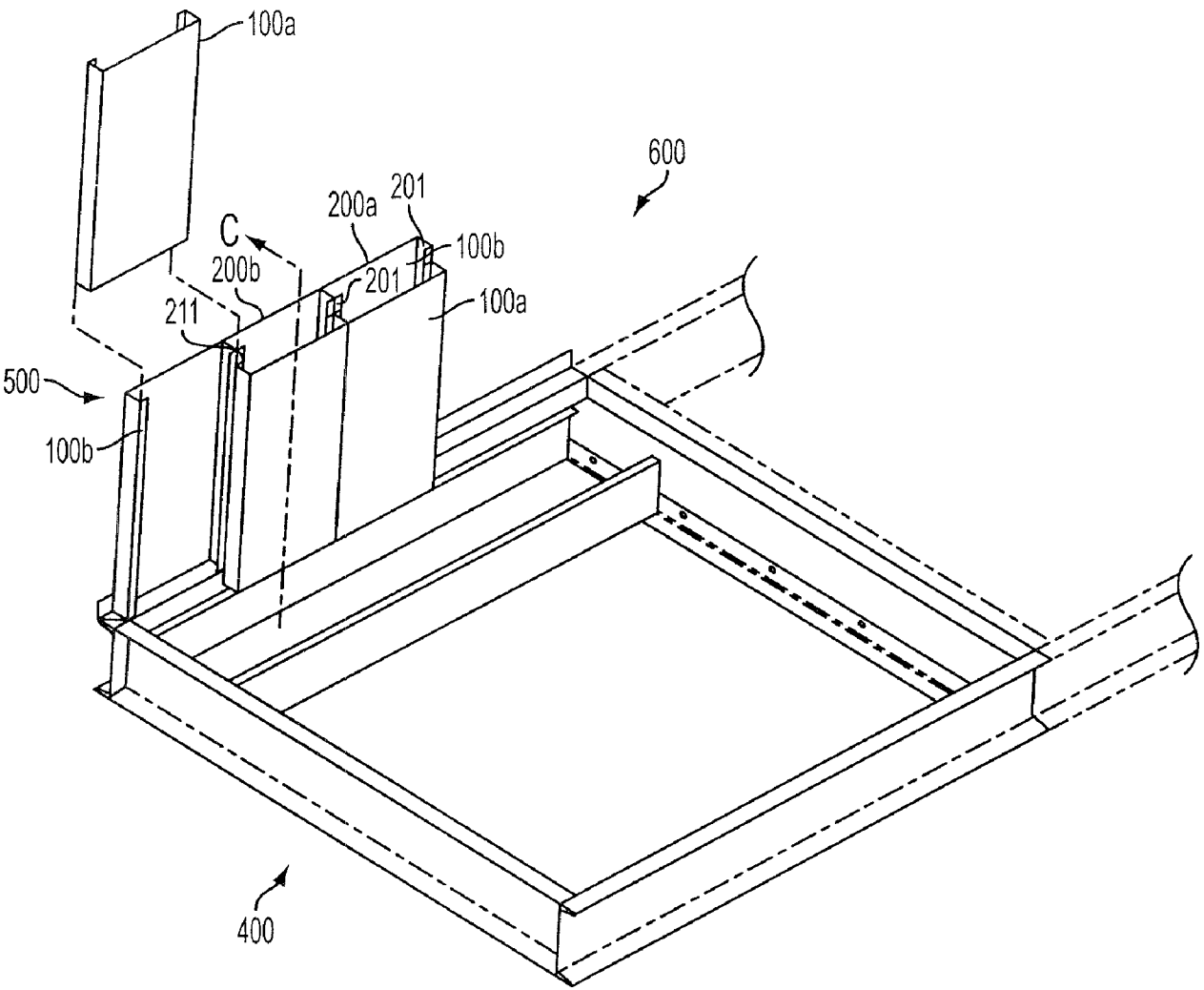
FIG. 6 shows a perspective view of a corner indicating how to connect a floor formed of half modular panels to a side wall formed of full modular panels to show interconnection without formation of a through metal path.

FIGS, 2A and 2B provide for views of a first assembly or first construct (200) which can be used in constructing a no-through-metal enclosure. The construct (200) is formed by assembly of two panels (100*a*) and (100*b*) in a mirror arrangement and may be assembled in place in the enclosure (600) (e.g. as shown in FIG. 6), which would generally be the more common construction. The first construct (200) comprises two panels (100*a*) and (100*b*) which are arranged to face each other so that their outer walls (101*a*) and (101*b*) are generally parallel, and their legs (113*a*), (113*b*), (123*a*) and (123*b*) project in opposing directions. The construct (200) is formed by connecting the outer surfaces (119*a*), (119*b*), (129*a*) and (129*b*) of their connecting surfaces to each other (generally in an opposing fashion) with a thin layer of insulation (201), such as insulation tape. This connection is made without using any form of metal connector, and therefore the thermal break layer (201) comprises a thermal break between the two panels (100*a*) and (100*b*). The outer walls (101*a*) and (101*b*) of each of the two panels (100*a*) and (100*b*) therefore form two relatively planar surfaces to the construct (200) which are generally parallel and form continuous surfaces of a now generally rectilinear box.

The outer walls (101*a*) and (101*b*) will then form either the exterior and interior walls of the enclosure (600), or will serve as support surfaces onto which sheets forming the walls will be attached. As should be clear and as is shown in FIG. 2B, the construct (200) has no direct through metal between the two panels (100*a*) and (100*b*) as the insulation strip between the panel's (100*a*) and (100*b*) connecting surfaces (119*a*), (119*b*), (129*a*), and (129*b*) provides for a thermal break. Therefore, connectors mounting to either panel (100*a*) or (100*b*) but not connecting between the panels (100*a*) and (100*b*), will not form a metal path through the construct (200). So long as the outer surface (101*a*) forms either the exterior or interior surface of the enclosure (600) and the outer surface (101*b*) forms the other, there is no through metal between the outer and inner surfaces of the enclosure so long as constructs (200) are arranged in common positioning such as that indicated in FIG. 6.

The insulating strip (201) may be any type of device but it is preferred to be formed of an insulating tape which provides for adhesion and serves to hold the two panels (100*a*) and (100*b*) in relative position. However, as will become clear, the insulation bond is not particularly load bearing as load applied against the bond ends up being distributed along the longitudinal dimension (H) and therefore is directed between the two opposing legs (113*a*) and (123*b*) or (123*a*) and (113*b*) in an "edge on" fashion, providing strength to the construct (200). In the remaining two directions, the longitudinal dimension (H) of the construct (200) provides load bearing, and along the latitudinal dimension (W) the outer walls (101*a*) and (101*b*) also provide edge on strength. For this reason, the panels (100*a*) and (100*b*) will generally not slip relative to each other unless a force is applied to one panel (100*a*) or (100*b*) to try and twist it relative to the other.

Figure 8B:
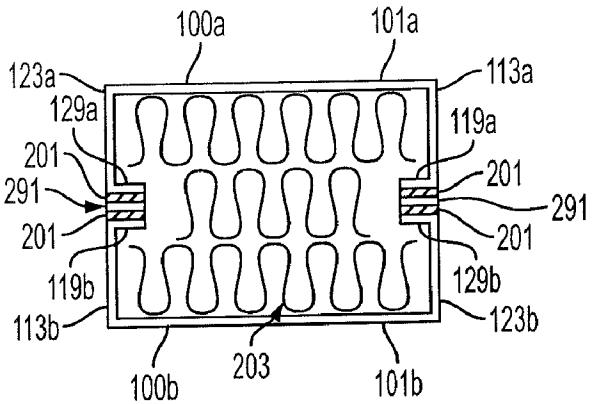
FIGS. 8A, 8B and 8C show various views of an alternative construct formed of two half panels which utilizes an additional thermal barrier.
Figure 8C:
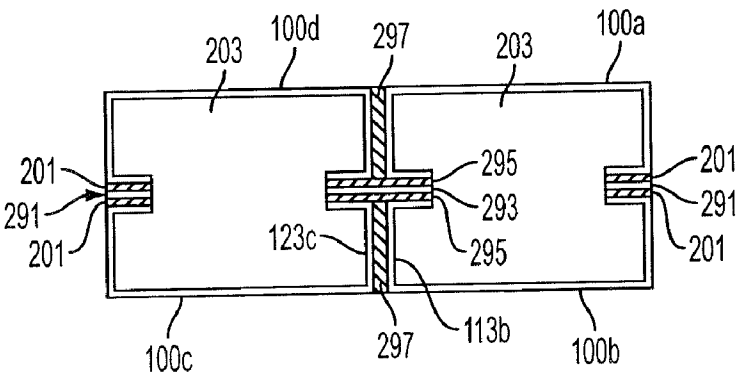
Figure 8A:
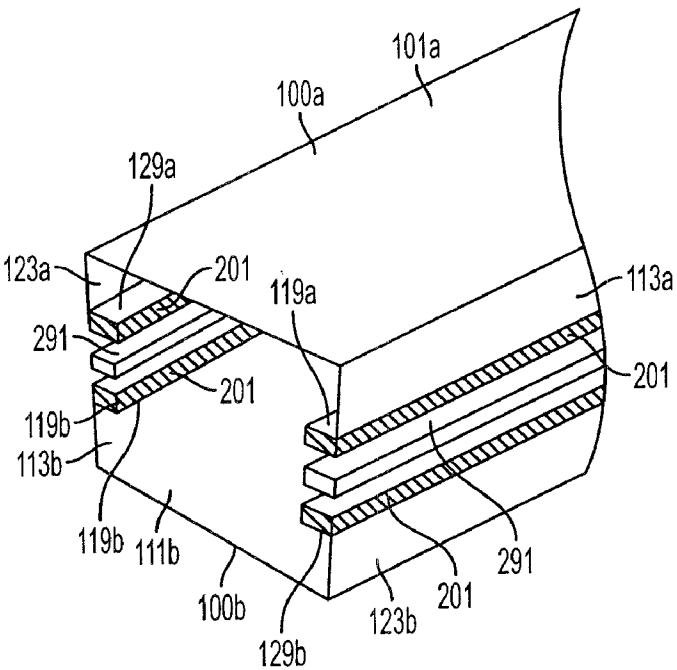

In the embodiment of FIG. 8, the connection between opposing legs (119) and (129) is provided with an additional thermal barrier in the form of additional strip insulation (291). The additional, strip insulation (291) is generally thicker than the insulating strip (201) and can be used where additional insulation is required. In the depicted embodiment, three pieces of strip insulation are used to separate the opposing panels (100*a*) and (100*b*). Two of the (201) type, which would generally be adhesive, and one of the (291) type which would generally not be. In a still further embodiment, since the strip insulation (201) can provide for a thermal barrier, the additional strip (291) can be of metal or other structure designed not to provide for a thermal barrier, but to provide structural strength.

As is shown particularly in FIG. 8C it is not required that the strip insulation (201) and (291) be confined to connection between only a single pair of panels. In an alternative embodiment, the strip insulation (293) and/or (295) may be arranged so as to extend between two or more adjacent panels. In this arrangement strip insulation (297) may also be placed between the adjacent legs (e.g. legs (113*b*) and (123*c*)) of the immediately adjacent panels. This design can provide for an improved insulative construction by providing further insulation between panels (100) and also can provide for more rigid construction particularly if the strip (293) has a more rigid construction than the strip (295) and provides structural support. In this embodiment, the strip (293) may or may not serve to provide thermal isolation. Similarly, the strip (297) may also provide for improved structural strength depending on the material chosen Twisting of the relative panel (100) structures may be minimized, in an embodiment, as shown in FIG. 6. In FIG. 6 neighboring panels (100) are connected in a generally parallel or common arrangement. As shown, each construct of a wall is arranged to place the relative longitudinal dimensions (H) generally parallel (in this case vertically) and has one leg of each construct connected to the leg on the same side (in the depth dimension (D)) of the adjacent construct. This connection will generally be by thermal insulation tape again to provide for improved air sealing, however, the adjacent legs between adjacent constructs (200*a*) and (200*b*) may also be penetrated by metal connectors as the existing thermal break between the two connecting panels (100*a*) and (100*b*) within each construct (200*a*) and (200*b*) is not crossed. With two constructs (200*a*) and (200*b*) placed adjacent and so connected, the ability to separate the panels (100*a*) and (100*b*) of any individual construct (200*a*) or (200*b*) by twisting is decreased. Further, as this repeated assembly of constructs will be repeated to form a wall, floor, ceiling, or other surface of enclosure (600), the longer the assembly is, generally the stronger and more rigid the assembly becomes. As discussed above, the interconnected structure of FIG. 8C can also be used to provide structural strength regardless of the number or nature of the strips (293) and/or (295) extending between adjacent constructs (200).

The interior of each construct (200) is generally filled with filler insulation (203). This acts to provide for the main insulative properties of the construct (200). Generally, the filler insulation (203) will be spun fiberglass insulation or a foam resin having desirable insulative properties but, as should be apparent, it may be any material, including air.

Figure 2B:
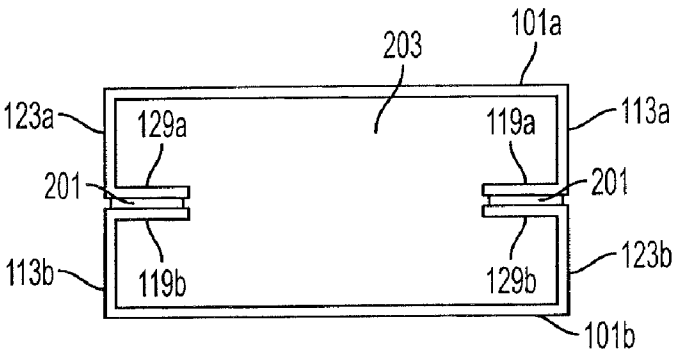
FIG. 2B shows a cut through view the same construct.
Figure 5B:
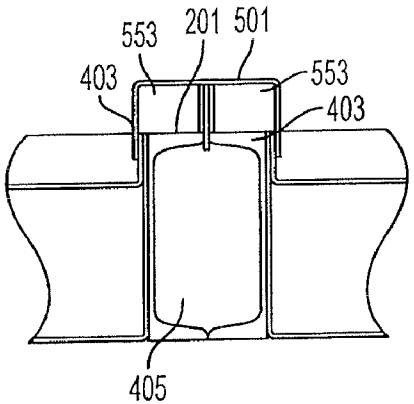
FIG. 5B provides for a cut through view of the floor of FIG. 4 along line B-B.
Figure 5A:
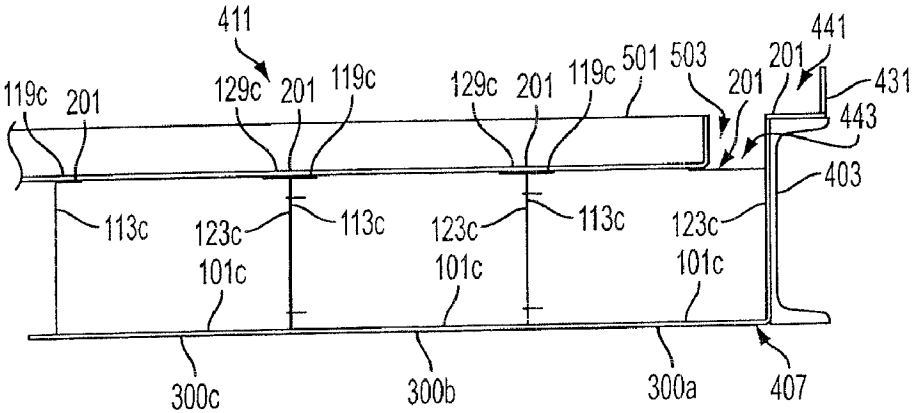
FIG. 5A shows a cut through view of the floor of FIG. 4 along line A-A provided as a floor with a flooring sheet in place.

FIG. 3 provides for a construct (300) of similar use to that of FIG. 2 however, the construct (300) of FIG. 3 uses a full panel (100*c*) as opposed to the two half panels (100*a*) and (100*b*) and is attached to a flat sheet (501) as shown in FIG. 5 to provide for an assembly having inner and outer surfaces. As opposed to the construct (200) of FIG. 2, the construct (300) of FIG. 3 comprises only a single panel (100*c*), generally with a depth (D) dimension of twice that of the panels (100*a*) and (100*b*) of FIG. 2. Instead of connecting the connecting surfaces (119*c*) and (129*c*) of panel (100*c*) to opposing connecting surfaces of another panel (100), the connecting surfaces (119*c*) and (129*c*) are connected to a flat metal sheet (501) via the same thermal blocking strip material (201) as was used between the opposing connecting surfaces (119*a*) and (129*b*) or (119*b*) and (129*a*) of FIG. 2. The flat metal sheet (501) as shown in FIG. 5A will generally extend across multiple constructs (300*a*), (300*b*), and (300*c*), whose adjacent legs are connected to each other in a similar fashion as was discussed for the assembly of the constructs (200) of FIGS. 2 and 8 as shown in FIGS. 6 and 8 except that each assembly only has a single leg on each side (instead of two separated legs). The interior of each construct (300) is also again filled with filler insulation (203). Therefore there is no-through-metal from the outer surface (101*c*) to the opposing side of the construct (300) (the sheet (501)).

It is generally preferred that constructs (200) be used for walls and constructs (300) be used for a floor (and possibly ceiling) as constructs (300) often provide for increased strength and the ability to provide for a textured surface on the floor more economically. Specifically, a construct (300) when covered by a textured metal sheet as overlaying sheet (501) in contact with insulation strips (201) does not create a duplicate metal surface as it would if the textured metal sheet (501) was placed against an outer wall (101) on a construct (200).

Figure 4:
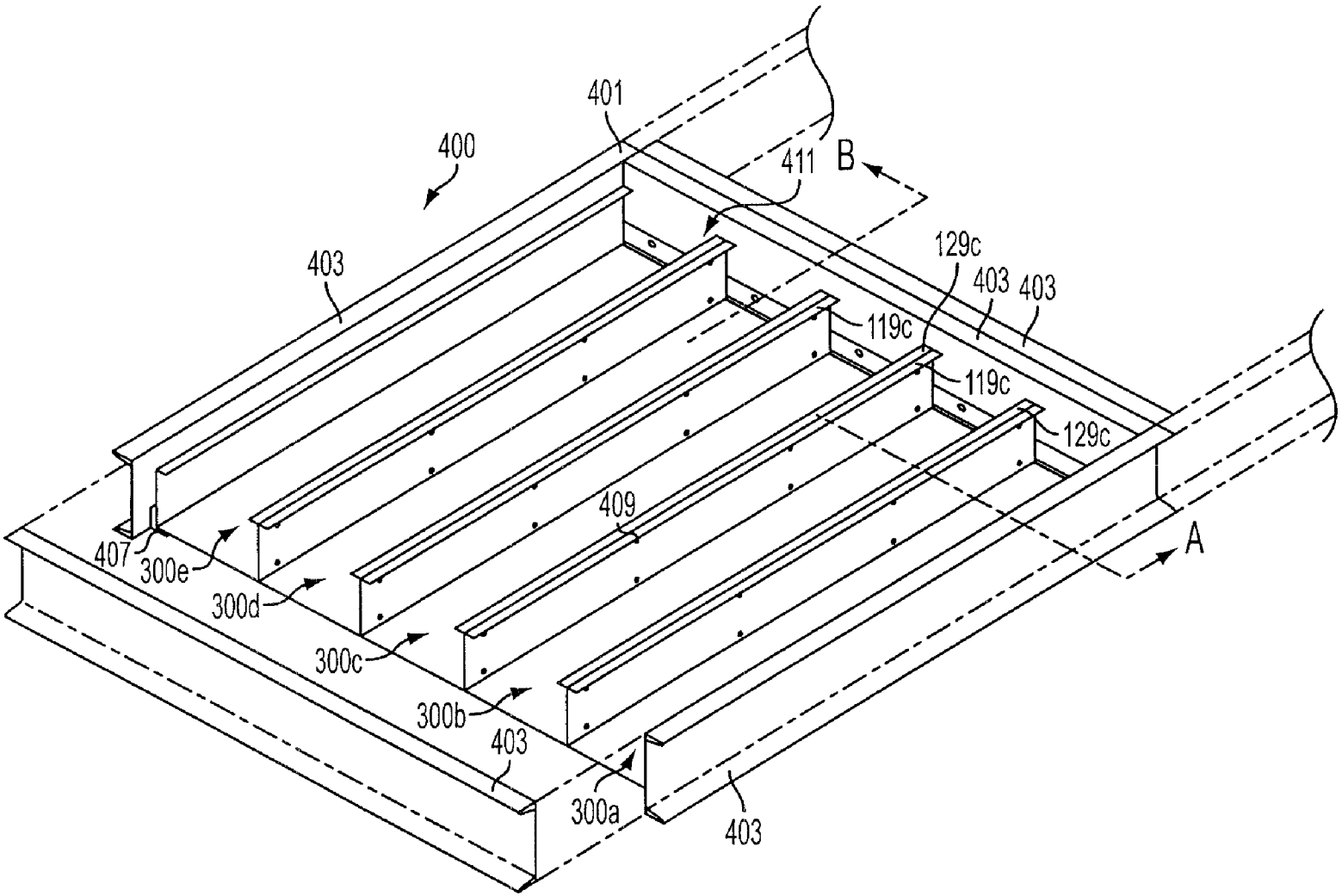
FIG. 4 shows a metal framed floor utilizing half modular panels.

To provide for strength and structure to the floor, in FIG. 4, there is provided an exterior frame (401) which is formed of C-beams (403). The beams are connected to each other to form a generally parallelogram shape, specifically a rectangle or square, with the flat major surfaces of each C-beam internal to the pattern and the open face of the C on the exterior. Adjacent C-beam ends may directly touch as there is no need to provide a thermal break there as it will be provided elsewhere. The void internal two adjacent C-beams is filled with insulation (405) as indicated in FIG. 5B.

Internal to the frame (401) are fitted the panels (300) so as to provide for a sub floor as indicated in FIG. 4. In the embodiment of FIG. 4 the floor includes five panels (300*a*), (300*b*), (300*c*), (300*d*), and (300*e*) but this number is by no means required. The panels may be connected to each other utilizing connectors (409) as indicated. However, the panels (300) will generally be connected to the frame (400) by use of an angle bracket (407) (such as a corner bracket shown forming an extended right angle bend upon which they rest. The angle bracket will generally be on at least two and often all four internal walls of the frame (400). As should be apparent, the angle bracket (407) can be connected to the frame (400) via connectors. Generally over the connector heads and the internal surfaces of the angle bracket (407) will be covered by a layer of sheet insulation onto which the assembly (411) of multiple constructs (300*a*), (300*b*), (300*c*), (300*d*), and (300*e*) is placed. As the assembly (411) is resting on the bracket (407), the bracket (407) and connectors serve to support the assembly (411) and strongly attach into the frame (401), without need to connect the assembly (411) to the frame (401) with connectors. The sheet insulation then serves to provide a thermal break between the floor assembly (411) and the frame (401).

As shown in FIG. 5A the sheet (501) forms a flooring deck, which will generally have a metal exterior surface placed in contact with the surface of the connecting tabs (119*c*) and (129*c*) of each of the panels (300*a*), (300*b*), (300*c*), (300*d*), and (300*e*). Each of the connecting tabs (119*c*) and (129*c*) of each panel (300*a*), (300*b*), (300*c*), (300*d*), and (300*e*) will be attached to the sheet (501) with sheet insulation (201) as discussed above. Generally, this sheet insulation (201) will also include an adhesive allowing the sheet (501) to be held securely to the sub floor assembly (411). There may be a slight space (503) provided which can act as a drain, if desired, or to provide for an offset of half of the constructs (200) forming the wall providing for a stepped connection as discussed later in conjunction with FIG. 6.

As shown in FIG. 5B, the point where one frame (401) of the floor meets another will provide for a cap (551), generally of metal, which is seated over the point of frame (401) connection. Internal to the cap (551) is again filled with insulation (553) and the exterior surface of the frame connection (which will form the interior of the building) is coated with sheet insulation (201) to separate the metal cap (551) from the frame (401). In this way the flames (401) are thermally isolated as essentially exterior metal, compared to the metal of the sheet (501). Further, the two sides of the floor, the sheet (501) and the outer walls (101*c*) of the panels (300*a*), (300*b*), (300*c*), (300*d*), and (300*e*) are also thermally isolated which results in isolation of "exterior surfaces" (the outer walls (101*c*) of the panels (300*a*), (300*b*), (300*c*), (300*d*), and (300*e*) and the frame (401), from "inner surfaces" (the sheet (501) forming the deck of the floor and the cap (551) on the frame (401)).

FIG. 6 further shows how a floor (400) in accordance with FIG. 4 may be connected to a vertical wall (500) formed using constructs (200). As shown in FIG. 5A, there extends up the rear of the C-beams (403) a sheet of insulation (201) which then extends over the upper leg of the C-beam (403) and over the lower half of an L shaped bracket (431). The upper leg of the L shaped bracket (431) extending upward from the C-beam (403). In conjunction with the gap left between the floor (501), the outer bracket (431), and the frame (411), this forms an essentially stair stepped design, in cross section. As should be apparent from FIG. 5A, the entire upper surface of the stair generally comprises sheet insulation (201). The only metal point of contact is the floor deck (501), which is already thermally isolated from the exterior surfaces by the sheet insulation (201) connecting it to the constructs (300*a*), (300*b*), (300*c*), (300*d*), and (300*e*).

FIG. 6 shows how a vertical wall (500) can then be constructed of constructs (200*a*), (200*b*) in interface with the sub floor assembly (411) and the frame (401), Specifically, the two panels (100*a*) and (100*b*) of each construct (200*a*) and (200*b*) are arranged slightly offset that one is resting on the "upper" step (441) while the other is resting on the lower step (443). Once so positioned the panels (100*a*) and (100*b*) may again be separated by the strip insulation (201) and may be filled with insulation (203).

As should be apparent. The corner where the vertical wall (500) intersects the floor (400) has no-through-metal because of the step design and interface between the constructs (200*a*) and (200*b*), the sub floor assembly (411), and the frame (401) having no metal path. Further, the floor (400) has no-through-metal due to the constructs (300*a*), (300*b*), (300*c*), (300*d*), and (300*e*) being thermally isolated from the floor deck (501). Finally, the wall (500) has no metal path due to the isolation of the panels (100*a*) and (100*b*) from each other by the thermal break (201) formed between them. Therefore, the basic construction of a no-through-metal enclosure (600) is completed. Further, as can be seen, the wall (500) is sturdy because of the L shaped brackets (431) holding each piece in place by the thermal insulation strip, which is generally adhesive. Also, in a number of places (as shown in a variety of FIGS.) metal connectors (409) can be used as the connection is isolated to one side of the enclosure or the other due to the center isolation from the panel construction.

Figure 7B:
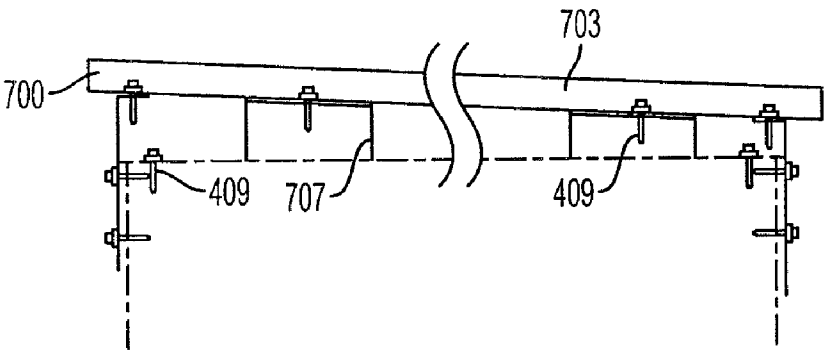
FIGS. 7A and 7B show cut through drawings of two roof formations on an enclosure.
Figure 7A:
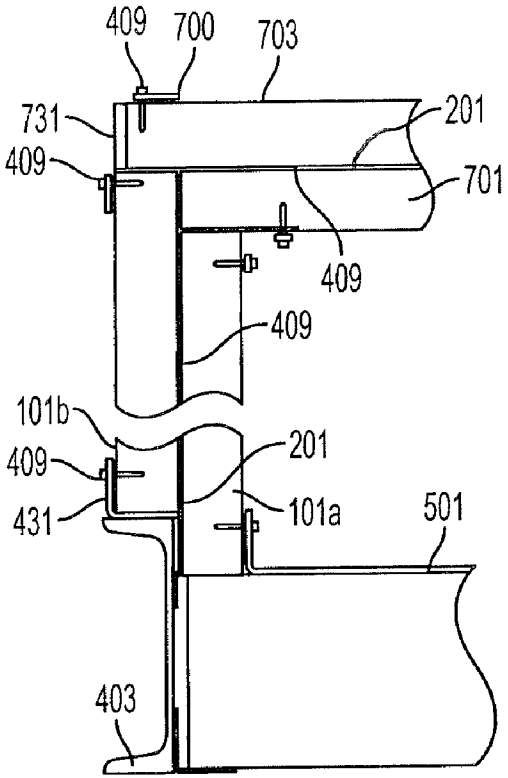

It should be apparent, as is shown in FIGS. 7A and 7B that the connection of a roof (700) to the wall (500) is effectively carried out in the same way as connection of the floor (400) to the wall (500). However, the roof (700) will not necessarily comprise the sub floor framing (401) as it may not need to be load bearing. Therefore, the roof (700) may be constructed of two differently sized panels (701) and (703), separated from each other by the sheet insulation (201) and again separated from the wall modules by a step shaped insulation shape similar to those of the floor (400) L brackets (731) may again be used to support the roof and potentially seal it down to the exterior to prevent it from being loosened by the wind. As shown in FIG. 7B, the roof may be slanted if desired simply by presenting internal slanted supports (707).

As should be apparent from the FIGS. and the above discussion, it is possible to form a no-through-metal enclosure utilizing only bent metal panels (100) and sheet insulation (201). Specifically, by providing for connection surfaces (119) and (129) as part of each panel (100) when forming wall (500) or floor (400) assemblies, the assemblies may utilize a purely adhesive connection and there is no need for this connection to have particular strength as force is transferred by the panels (100) to more rigid points of connection or their own design Therefore the system provides for a no-through-metal enclosure without the need to utilize expensive cast shapes or milling of preassembled insulation and metal co-structures. This provides for significantly easier and less expensive construction of the assembly materials as they can use sheet metal as their primary construction material. In effect, the entire structure requires only the use of the panels (100) as described in FIG. 1 (which are easily formed from sheet metal by simple bending processes) in two different depths, common L bracketing, standard C beams (403), and flat metal sheeting (501), (703) and (701) for use as roof and floor. Since the panels (100) are also only one of two depths (and may actually be the same depth if desired) these can be produced from large sheets in bulk, the sheets may then be cut to the desired latitudinal lengths (H) based on the desired dimensions of the enclosure. This makes the no-through-metal enclosure significantly easier to construct and much more cost effective than those utilizing custom cast metal structures including preformed resin components and milled removal of portions of the I's. Alternatively, the panels (100) may be used for any portion of the structure, utilizing other methodologies of construction for the rest of the enclosure.

It should be recognized that the enclosure shown in the drawings does have some exterior and interior seams where the strip insulation would be accessible from the exterior or interior surface of the enclosure. This would generally be acceptable in most circumstances so long as the strip insulation is sufficiently resistive to common solvents it would be exposed to. However, should it be undesirable, the entirety of the exterior or interior surface, or a portion covering the exposed joins) may be covered by a single monolithic sheet of metal to eliminate all but limited corner joins (which may also be nearly eliminated through the use of bends or welds). As the interior and exterior structures already are separated, such inclusion of additional metal entirely exterior or interior does not create any metal paths even if attached with metal fasteners.

While it is not necessary for enclosures discussed herein to have particular properties, it has generally been found that such enclosures will have low to no air leakage providing significantly improved thermal performance as well as sealing, and efficiency, compared to other enclosures. Further, such enclosures generally provide sonic insulation as well. Enclosures constructed in accordance with the teachings herein are also often structurally stronger than other designs which can provide for less deflection of the enclosure, such as in high winds, since the enclosure utilizes significant connection area and can utilize metal connections at most points between panels.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A no-through-metal enclosure, the enclosure comprising:

a floor comprised of a plurality of generally C-shaped panels, each of said panels being formed from a sheet of bent metal, and each of said panels comprising:

an outer wall which comprises the back of the generally C-shaped panel;

two legs attached to opposite terminating ends of said outer wall which extend from the plane of the outer wall; and two connecting surfaces attached to the terminating ends of each of the legs, each connecting surface extending inward from the legs towards each other in a plane generally parallel with the outer wall, the two connecting surfaces being spaced from each other by a distance;

wherein said plurality of panels of said floor are connected adjacently together along the length of said legs of said panels such that the outer walls of the plurality of panels are generally linear;

wherein a panel whose outer surface forms a portion of an outer metal surface of said floor is connected to an interior metal surface of said floor only via insulative strips which are placed on the side of said connecting surfaces opposing the outer wall; and wherein said floor has no-through-metal from said outer metal surface to said interior metal surface; and a wall substantially perpendicularly connected to said floor, said wall comprised of at least two generally C-shaped panels, each of said panels being formed from a sheet of bent metal, and each of said panels comprising:

an outer wall which comprises the back of the generally C-shaped panel;

two legs attached to opposite terminating ends of said outer wall which extend from the plane of the outer wall: and two connecting surfaces attached to the terminating ends of each of the legs, each connecting surface extending inward from the legs towards each other in a plane generally parallel with the outer wall, the two connecting surfaces being spaced from each other by a distance;

wherein said at least two panels are partially connected together via a portion of said connecting surfaces only via insulative strips which are placed on the side of said connecting surfaces opposing the outer wall and such that the length of the connected panels is greater than the length of one of the individual panels; and wherein said wall has no-through-metal between the outer walls of the connected panels.

2. The enclosure of claim 1 wherein said interior metal surface is at least partially formed from a flat sheet of metal which is connected to said insulative strip.

3. The enclosure of claim 2 wherein said flat sheet of metal forms a floor of said enclosure.

4. The enclosure of claim 1 further comprising: metal fasteners connecting at least one of said adjacent panels of said floor to another of said adjacent panels of said floor.

5. The enclosure of claim 4 wherein said interior metal surface is at least partially formed from a flat sheet of metal which is connected to said insulative strip.

6. The enclosure of claim 4 wherein said legs of said adjacent panels of said floor are connected by said metal fasteners.

7. A modular no-through-metal construction panel enclosure comprising:

a first C-shaped panel formed from a sheet of bent metal, said first panel comprising:

an outer wall which comprises the back of the generally C-shaped panel;

two legs attached to opposite terminating ends of said outer wall which extend from the plane of the outer wall; and two connecting surfaces attached to the terminating ends of each of the legs, each connecting surface extending inward from the legs towards each other in a plane generally parallel with the outer wall, the two connecting surfaces being spaced from each other by a distance; and a second C-shaped panel formed from a sheet of bent metal, said second panel comprising:

an outer wall which comprises the back of the generally C-shaped panel;

two legs attached to opposite terminating ends of said outer wall which extend from the plane of the outer wall; and two connecting surfaces attached to the terminating ends of each of the legs, each connecting surface extending inward from the legs towards each other in a plane generally parallel with the outer wall, the two connecting surfaces being spaced from each other by a distance;

a third C-shaped panel formed from a sheet of bent metal, said third panel comprising:

an outer wall which comprises the back of the generally C-shaped panel;

two legs attached to opposite terminating ends of said outer wall which extend from the plane of the outer wall; and two connecting surfaces attached to the terminating ends of each of the legs, each connecting surface extending inward from the legs towards each other in a plane generally parallel with the outer wall, the two connecting surfaces being spaced from each other by a distance:

a fourth C-shaped panel formed from a sheet of bent metal, said fourth panel comprising:

an outer wall which comprises the back of the generally C-shaped panel;

two legs attached to opposite terminating ends of said outer wall which extend from the plane of the outer wall; and two connecting surfaces attached to the terminating ends of each of the legs, each connecting surface extending inward from the legs towards each other in a plane generally parallel with the outer wall, the two connecting surfaces being spaced from each other by a distance;

wherein the sides of said connecting surfaces opposing the outer wall on said first panel are connected to the sides of said connecting surfaces opposing the outer wall on said second panel via an insulative material which is placed on the side of said connecting surfaces opposing the associated outer wall;

wherein the sides of said connecting surfaces opposing the outer wall on said third panel are connected to the sides of said connecting surfaces opposing the outer wall on said fourth panel via an insulative material which is placed on the side of said connecting surfaces opposing the associated outer wall;

wherein said legs on said first panel are connected to said legs on said third panel via an insulative material such that the outer walls of the first and third panels are generally linear;

wherein said legs on said second panel are connected to said legs on said fourth panel via an insulative material such that the outer walls of the second and fourth panels are generally linear;

wherein said connected connecting surfaces and said legs have no metal connectors therethrough; and wherein said first, second, third and fourth panels are each filled with insulative material.

8. The modular no-through-metal construction panel enclosure of claim 7 further comprising a fifth C-shaped panel formed from a sheet of bent metal, said fifth panel comprising:

an outer wall which comprises the back of the generally C-shaped panel;

two legs attached to opposite terminating ends of said outer wall which extend from the plane of the outer wall; and two connecting surfaces attached to the terminating ends of each of the legs, each connecting surface extending inward from the legs towards each other in a plane generally parallel with the outer wall, the two connecting surfaces being spaced from each other by a distance; and wherein one of said connecting surfaces of said fifth panel is perpendicularly connected to said outer wall of said first panel via an insulative material such that the leg of the fifth panel is generally parallel with the outer wall of said first panel.

9. The method of claim 8 further comprising:

providing a fifth C-shaped panel formed from a sheet of bent material, said fifth panel comprising:

an outer wall which comprises the back of the generally C-shaped panel;

two legs attached to opposite terminating ends of said outer wall which extend from the plane of the outer wall; and two connecting surfaces attached to the terminating ends of each of the legs, each connecting surface extending inward from the legs towards each other in a plane generally parallel with the outer wall, the two connecting surfaces being spaced from each other by a distance; and placing an insulative strip on each of the sides of said connecting surfaces opposing the outer wall of said fifth panel;

connecting one of said connecting surfaces of said fifth panel perpendicularly to said outer wall of said first panel such that said leg of said fifth panel is generally parallel with said outer wall of said first panel.

10. The method of claim 9 further comprising:

providing a flat sheet;

connecting said flat sheet to said connecting surfaces of said fifth panel via the insulative strip to form a floor of said enclosure.

11. The method of claim 10 wherein said flat sheet of material comprises metal.

12. The method of claim 9 further comprising:

providing a sixth C-shaped panel formed from a sheet of bent material, said sixth panel comprising:

an outer wall which comprises the back of the generally C-shaped panel;

two legs attached to opposite terminating ends of said outer wall which extend from the plane of the outer wall; and two connecting surfaces attached to the terminating ends of each of the legs, each connecting surface extending inward from the legs towards each other in a plane generally parallel with the outer wall, the two connecting surfaces being spaced from each other by a distance; and placing an insulative strip on each of the sides of said connecting surfaces opposing the outer wall of said sixth panel;

connecting one of said one of said legs of said sixth panel is connected along the length of said leg of said fifth panel such that the outer walls of said fifth and sixth panels are generally linear.

13. The method of claim 12 wherein said sheet of bent material of said first, second, third, fourth, fifth, and sixth panels comprises metal.

14. The method of claim 12 wherein said legs of said fifth and sixth panels are connected by metal fasteners.

15. The method of claim 12 wherein said legs of said fifth and sixth panels are connected by non-metal fasteners.

16. The method of claim 9 wherein said first panel and said fifth panel are connected by a generally L-shaped bracket.

17. A method of constructing a no-through-metal enclosure comprising:

providing a first C-shaped panel formed from a sheet of bent material, said first panel comprising:

an outer wall which comprises the back of the generally C-shaped panel;

two legs attached to opposite terminating ends of said outer wall which extend from the plane of the outer wall; and two connecting surfaces attached to the terminating ends of each of the legs, each connecting surface extending inward from the legs towards each other in a plane generally parallel with the outer wall, the two connecting surfaces being spaced from each other by a distance; and providing a second C-shaped panel formed from a sheet of bent material, said second panel comprising:

an outer wall which comprises the back of the generally C-shaped panel;

two legs attached to opposite terminating ends of said outer wall which extend from the plane of the outer wall; and two connecting surfaces attached to the terminating ends of each of the legs, each connecting surface extending inward from the legs towards each other in a plane generally parallel with the outer wall, the two connecting surfaces being spaced from each other by a distance;

providing a third C-shaped panel formed from a sheet of bent material, said third panel comprising:

an outer wall which comprises the back of the generally C-shaped panel;

two legs attached to opposite terminating ends of said outer wall which extend from the plane of the outer wall; and two connecting surfaces attached to the terminating ends of each of the legs, each connecting surface extending inward from the legs towards each other in a plane generally parallel with the outer wall, the two connecting surfaces being spaced from each other by a distance;

providing a fourth C-shaped panel formed from a sheet of bent material, said fourth panel comprising:

an outer wall which comprises the back of the generally C-shaped panel;

two legs attached to opposite terminating ends of said outer wall which extend from the plane of the outer wall; and two connecting surfaces attached to the terminating ends of each of the legs, each connecting surface extending inward from the legs towards each other in a plane generally parallel with the outer wall, the two connecting surfaces being spaced from each other by a distance;

placing an insulative strip on each of the sides of said connecting surfaces opposing the outer wall of said first, second, third and fourth panels;

connecting the sides of said connecting surfaces opposing the outer wall on said first panel to the sides of said connecting surfaces opposing the outer wall on said second panel via the insulative strip to form a space between the outer wall of said first panel and the outer wall of said second panel;

connecting the sides of said connecting surfaces opposing the outer wall on said third panel to the sides of said connecting surfaces opposing the outer wall on said fourth panel via the insulative strip to form a space between the outer wall of said third panel and the outer wall of said fourth panel;

connecting said legs on said first panel to said legs on said third panel via an insulative material such that the outer walls of the first and third panels are generally linear;

connecting said legs on said second panel to said legs on said fourth panel via an insulative material such that the outer walls of the second and fourth panels are generally linear;

filing with an insulative material said space between the outer wall of said first panel and the outer wall of said second panel;

filing with an insulative material said space between the outer wall of said third panel and the outer wall of said fourth panel; and using said connected first, second, third, and fourth panels to form a wall.

* * * * *